US008011649B2

(12) United States Patent
Yahata et al.

(10) Patent No.: US 8,011,649 B2
(45) Date of Patent: Sep. 6, 2011

(54) SHEET PROCESSING APPARATUS AND SHEET PROCESSING METHOD

(75) Inventors: Isao Yahata, Shizuoka-ken (JP); Ken Iguchi, Shizuoka-ken (JP); Kouichirou Yada, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 429 days.

(21) Appl. No.: 12/178,348

(22) Filed: Jul. 23, 2008

(65) Prior Publication Data

US 2009/0033028 A1 Feb. 5, 2009

Related U.S. Application Data

(60) Provisional application No. 60/952,838, filed on Jul. 30, 2007, provisional application No. 60/968,544, filed on Aug. 28, 2007, provisional application No. 60/968,851, filed on Aug. 29, 2007.

(30) Foreign Application Priority Data

Mar. 14, 2008 (JP) ..... P2008-066001

(51) Int. Cl.
*B65H 37/00* (2006.01)

(52) U.S. Cl. ..... 270/58.07

(58) Field of Classification Search ..... 270/58.07, 270/58.17, 58.27

See application file for complete search history.

(56) References Cited

U.S. PATENT DOCUMENTS

| | | | | |
|---|---|---|---|---|
| 5,253,030 | A | 10/1993 | Shigemura et al. | |
| 6,907,806 | B1 * | 6/2005 | Okamoto et al. | 83/76.8 |
| 7,007,577 | B2 * | 3/2006 | Okamoto et al. | 83/76.8 |
| 7,520,497 | B2 * | 4/2009 | Moriyama et al. | 270/58.07 |
| 7,578,498 | B2 * | 8/2009 | Iguchi et al. | 270/58.07 |
| 2005/0212194 | A1 * | 9/2005 | Moriyama et al. | 270/58.08 |

FOREIGN PATENT DOCUMENTS

| | | |
|---|---|---|
| JP | 05-85081 | 4/1993 |
| JP | 09-244325 | 9/1997 |

(Continued)

*Primary Examiner* — Leslie A Nicholson, III
(74) *Attorney, Agent, or Firm* — Patterson & Sheridan, LLP

(57) ABSTRACT

A sheet processing apparatus includes a first detector configured to detect a leading edge of a sheet conveyed in a conveying direction, a second detector provided on a downstream side of the first detector in the sheet conveying direction to detect the leading edge of the sheet conveyed, a punching portion, in the downstream side of the first detector in the sheet conveying direction, to move in a sheet width direction crossing the sheet conveying direction and perform a punching process for the sheet, an edge detector configured to move in the width direction together with the punching portion and detect the edge of the sheet conveyed in the width direction, and a controller, on the basis of at least either of information of a conveying speed of the sheet and a sheet length in the conveying direction, when the edge detector starts movement in the width direction after the first or second detector detects the leading edge of the sheet, to judge whether the edge detector can detect the edge of the sheet or not, as a result of the judgment, selecting the detector positioned on the most downstream side in the conveying direction among the first and second detectors which can be used, and when the selected first or second detector detects the leading edge of the sheet conveyed, permitting the edge detector to start movement to detect the edge of the sheet in the width direction.

12 Claims, 10 Drawing Sheets

FOREIGN PATENT DOCUMENTS

| | | |
|---|---|---|
| JP | 10-279170 | 10/1998 |
| JP | 11-139675 | 5/1999 |
| JP | 11-208971 | 8/1999 |
| JP | 11-343060 | 12/1999 |
| JP | 2001-130827 | 5/2001 |
| JP | 2005-96005 | 4/2005 |
| JP | 2006-16129 | 1/2006 |
| JP | 2007-76862 | 3/2007 |

* cited by examiner

SHEET PROCESSING APPARATUS AND SHEET PROCESSING METHOD

CROSS-REFERENCE TO RELATED APPLICATION

This application is based upon and claims the benefit of priority from the prior U.S. Patent Application No. 60/952,838, filed on Jul. 30, 2007; the entire contents of all of which are incorporated herein by reference.

This application is based upon and claims the benefit of priority from the prior U.S. Patent Application No. 60/968,544, filed on Aug. 28, 2007; the entire contents of all of which are incorporated herein by reference.

This application is based upon and claims the benefit of priority from the prior U.S. Patent Application No. 60/968,851, filed on Aug. 29, 2007; the entire contents of all of which are incorporated herein by reference.

This application is based upon and claims the benefit of priority from the prior Japanese Patent Application No. 2008-66001, filed on Mar. 14, 2008; the entire contents of all of which are incorporated herein by reference.

FIELD OF THE INVENTION

The present invention relates to a sheet processing apparatus and a sheet processing method for performing a punching process for sheets conveyed.

DESCRIPTION OF THE BACKGROUND

Japanese Patent Application Publication No. 2007-91369 discloses a sheet processing apparatus to perform processes of sorting, stitching and punching.

The apparatus includes a punch unit, an adjustment unit, a sensor unit and a changeover switch. The punch unit punches the sheets discharged sequentially from the image forming apparatus. The adjustment unit slides the punch unit in the direction crossing the sheet conveying direction and adjusts the punching position. The sensor unit is installed in the sliding punch unit and comprises a trailing edge sensor to detect the leading edge and trailing edge of a sheet in the conveying direction and a lateral register sensor to start movement at predetermined timing after detection of the leading edge of the sheet by the trailing edge sensor and detecting the lateral edge of the sheet. The changeover switch goes over between a high productivity mode and a precision mode. In the high productivity mode, the trailing edge sensor detects the leading edge of the sheet and then the lateral register sensor starts movement at early timing and detects the lateral edge of the sheet on the leading edge side of the sheet conveyed, thus the time required for the punching process is shortened. In the precision mode, the lateral register sensor starts movement inversely at late timing and detects the trailing edge side of the sheet when the conveyance of the sheet is stopped, thus the hole position is decided accurately at the sacrifice of the processing time.

However, in the aforementioned apparatus, even in the high productivity mode or the precision mode, regardless of the sheet size and sheet conveying speed, the lateral register sensor starts movement after the trailing edge sensor detects the leading edge of the sheet. Therefore, if the conveying speed is increased to improve the processing performance, a problem arises that the driving up to the detection position is too late. Particularly, as the size of the sheet in the width direction crossing the conveying direction becomes smaller, the movement distance from the standby position outside the lateral edge of the sheet to the lateral edge on the sheet becomes longer is increased. Therefore, the time until the position for detecting the lateral edge of the sheet becomes longer, so that as the sheet size in the width direction becomes smaller, it is impossible to increase the conveying speed and improve the performance.

SUMMARY OF THE INVENTION

The present invention is intended to provide a sheet processing apparatus and s sheet processing method to speed up the punching process and improving the performance.

To accomplish the above object, in an embodiment, there is provided a sheet processing apparatus comprising a first detector configured to detect a leading edge of a sheet conveyed in a conveying direction; a second detector provided on a downstream side of the first detector in the sheet conveying direction to detect the leading edge of the sheet conveyed; a punching portion, in the downstream side of the first detector in the sheet conveying direction, to move in a sheet width direction crossing the sheet conveying direction and perform a punching process for the sheet; an edge detector configured to move in the width direction together with the punching portion and detect the edge of the sheet conveyed in the width direction; and a controller, on the basis of at least either of information of a conveying speed of the sheet and a sheet length in the conveying direction, when the edge detector starts movement in the width direction after the first or second detector detects the leading edge of the sheet, to judge whether the edge detector can detect the edge of the sheet or not, as a result of the judgment, selecting the detector positioned on the most downstream side in the conveying direction among the first and second detectors which can be used, and when the selected first or second detector detects the leading edge of the sheet conveyed, permitting the edge detector to start movement to detect the edge of the sheet in the width direction.

Furthermore, to accomplish the above object, in an embodiment, there is provided a processing method of a sheet processing apparatus including a first detector configured to detect a leading edge of a sheet conveyed in a conveying direction, a second detector provided on a downstream side of the first detector in the sheet conveying direction to detect the leading edge of the sheet conveyed, a punching portion, on the downstream side of the first detector in the sheet conveying direction, to move in a sheet width direction crossing the sheet conveying direction and perform a punching process for the sheet, and an edge detector configured to move in the width direction together with the punching portion and detect the edge of the sheet conveyed in the width direction, comprising judging whether the edge detector can detect the edge of the sheet or not on the basis of at least either of information of a conveying speed of the sheet and a sheet length in the conveying direction, when the edge detector starts movement in the width direction after the first or second detector detects the leading edge of the sheet; selecting the detector positioned on the most downstream side in the conveying direction among the usable first and second detectors on the basis of a result of the judgment; and permitting the edge detector to start movement and to detect the edge of the sheet when the selected first or second detector detects the leading edge of the sheet conveyed.

BRIEF DESCRIPTION OF THE DRAWINGS

FIG. 10A is a front view showing the state that the punch head moves down, and FIG. 10B is a plan view of the punching portion shown in FIG. 10A viewed from above, and FIG. 10C is a front view showing the state that the punch head moves up.

DETAILED DESCRIPTION OF THE INVENTION

Hereinafter, the embodiments will be explained with reference to the accompanying drawings.

Figure 1:
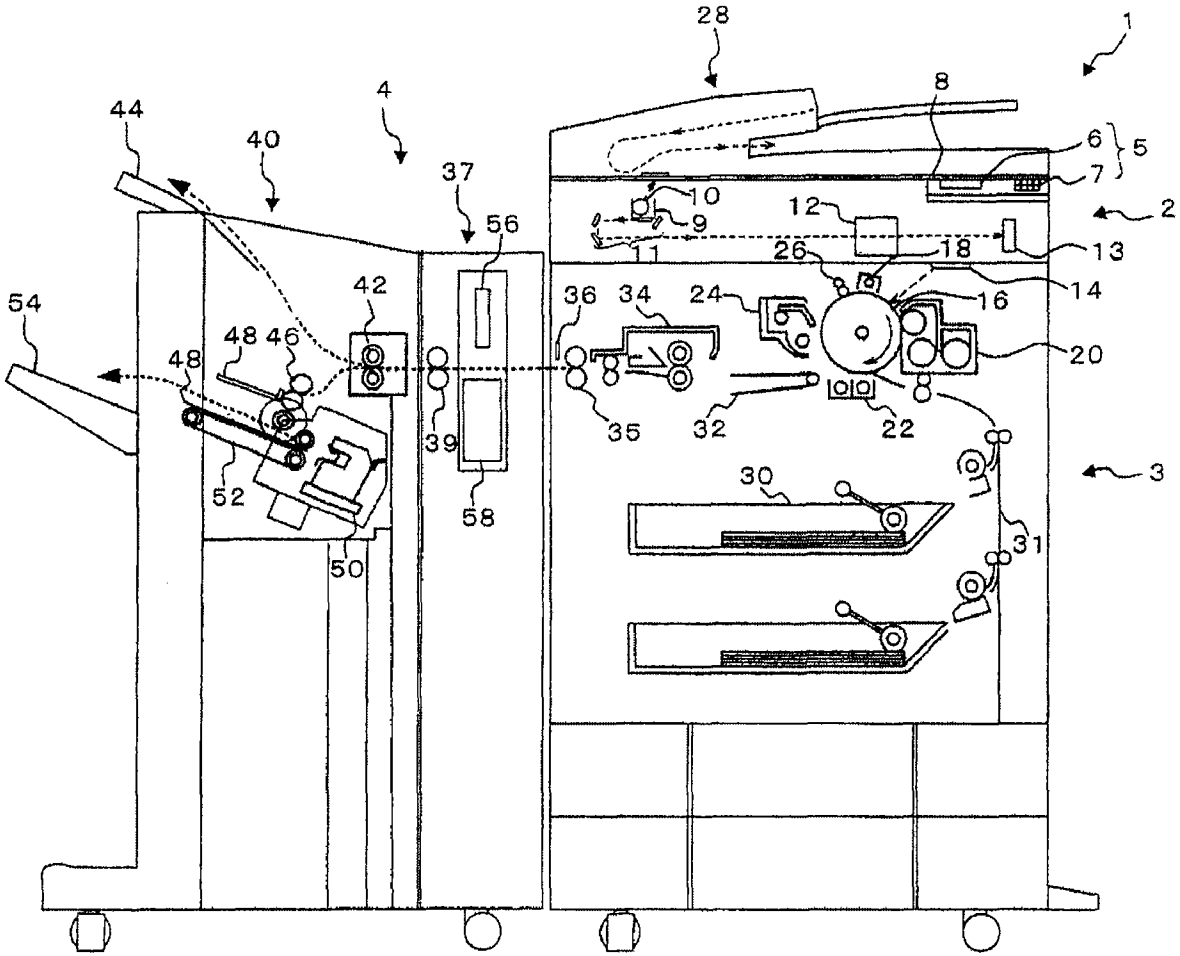
FIG. 1 is a schematic view of the image forming apparatus having the sheet processing apparatus.

(First Embodiment) FIG. 1 is a schematic view of the image forming apparatus having the sheet processing apparatus.

An image forming apparatus 1 includes an image reading portion 2 for reading an image to be read and an image forming portion 3 for forming an image. On the upper part of the image forming apparatus 1, an operation panel 5 including a display 6 of a touch panel type and various operation keys is installed.

The operation keys 7 of the operation panel 5 has, for example, ten keys, a reset key, a stop key, and a start key. On the display 6, the sheet size, the number of copies, and various processes such as the punching process are displayed and input.

The image reading portion 2 includes a transmissible original table 8, a carriage 9, an exposure lamp 10, a reflection mirror 11, an imaging lens 12 to converge reflected light, and a CCD 13 (charge coupled device) to fetch the reflected light and convert image information to an analog signal.

The image forming portion 3 includes a photoconductor 16, a laser unit 14 for forming an electrostatic latent image on the photoconductor 16, and a charger 18, a developing device 20, a transferring device 22, a cleaner 24, and a charge elimination lamp 26 which are sequentially arranged around the photoconductor 16.

To a document put on the original table 8 or a document sent by an automatic document feeder 28, by an exposure unit including the carriage 9 and the exposure lamp 10 installed on the carriage 9, light is irradiated from underneath the original-table 8. Reflected light from the document irradiated with light is induced by the reflection mirror 11 and is converged by the imaging lens 12, and a reflected light image is projected onto the CCD 13. The image information fetched by the CCD 13 is output as an analog signal, is converted to a digital signal, is image-processed, and then is transmitted to the laser unit 14.

When the image forming portion 3 starts image formation, the charger 18 supplies a charge to the outer peripheral surface of the photoconductor 16. Onto the outer peripheral surface of the photoconductor 16 which is charged at a uniform potential in the axial direction by the charger 18, according to the image information transmitted from the CCD 13, a laser beam is irradiated from the laser unit 14. By the irradiation of the laser beam, an electrostatic latent image corresponding to the image information of the document is formed on the outer peripheral surface of the photoconductor 16. Then, a developer (for example, toner) is fed to the outer peripheral surface of the photoconductor 16 by the developing device 20 and the electrostatic latent image is converted to a toner image.

The developing device 20 has a developing roller installed rotatably and the developing roller is arranged opposite to the photoconductor 16 and is rotated, thus toner is fed to the photoconductor 16. If a toner image is formed on the outer peripheral surface of the photoconductor 16, onto a sheet conveyed from a sheet feeder 30 via a conveying path 31, the toner image is electrostatically transferred by the transferring device 22. The toner remaining on the photoconductor 16 without transferred is removed by the cleaner 24 positioned on the downstream side of the transferring device 22 in the rotational direction of the photoconductor 16. Furthermore, the residual electric charge on the outer peripheral surface of the photoconductor 16 is removed by the charge elimination lamp 26.

The sheet onto which the toner image is transferred is conveyed to a fixing device 34 via a conveyor belt 32. The toner image transferred onto the sheet is fixed on the sheet by the fixing device 34. The sheet that the toner image is fixed, thus the image formation is completed is discharged from the image forming apparatus 1 by discharge rollers 35 and are sent to a sheet finishing apparatus 4. An end sensor 36 detects finally the sheet sent to the sheet finishing apparatus 4 on the side of the image forming apparatus 1. The sheet may be plain paper, heavy paper, thin paper, glossy paper, or an OHP sheet.

The sheet finishing apparatus 4 post-processes the sheet carried out from the image forming apparatus 1 according to an input instruction from the operation panel of the image forming apparatus 1 or a processing instruction from a PC (Personal Computer). The sheet finishing apparatus 4 includes a punch portion 37 for forming a punch hole in a sheet and a finishing portion 40, for example, for performing an ordinary sorting process or a stitching process of stitching the edge portion of a sheet bundle.

The punch portion 37 includes first rollers 39 for conveying a sheet carried out from the image forming apparatus 1, a punch unit 56, and a dust box 58 for collecting waste generated by the punching process which is dropped.

The finishing portion 40 includes a first discharge tray 44 for receiving sheets for which the sorting process and stitching process are not performed, a processing tray 49 for loading a sheet bundle for which the stitching process is performed, a stapler 50 for stitching a sheet bundle, and a second discharge tray 54 drivable vertically for receiving the sheet bundle which is stitched and sorted.

In the finishing portion 40, second rollers 42 carry a sheet conveyed via the punch portion 37 into the finishing portion 40. If the post process is not performed for the sheet, the finishing portion 40 discharges straight the sheet to the first discharge tray 44.

When performing the stitching process and sorting process, the sheet carried into the finishing portion 40 by the second rollers 42 is conveyed to a waiting tray 48 by third rollers 46.

The waiting tray 48 permits the conveyed plurality of sheets temporarily stores. The waiting tray 48 drops the stored sheets onto the processing tray 49 arranged under the waiting tray 48.

When performing the stitching process, the processing tray 49 stores the number of sheets which is instructed from the operation panel or PC and the stapler 50 performs the stitching process for the sheet bundle. If the sheet bundle is stitched by the stapler 50, a conveying mechanism 52 drives so as to carry out the sheet bundle to the second discharge tray 54. When performing the sorting process, the stitching process by the stapler 50 is not performed for the sheets stored on the processing tray 49 and the conveying mechanism 52 drives so as to carry out the sheets to the second discharge tray 54. For such an edge finishing portion 40, the post-processing apparatus described in Japanese Patent Application Publication No.2007-76862 and also the well-known arts can be used.

Figure 2:
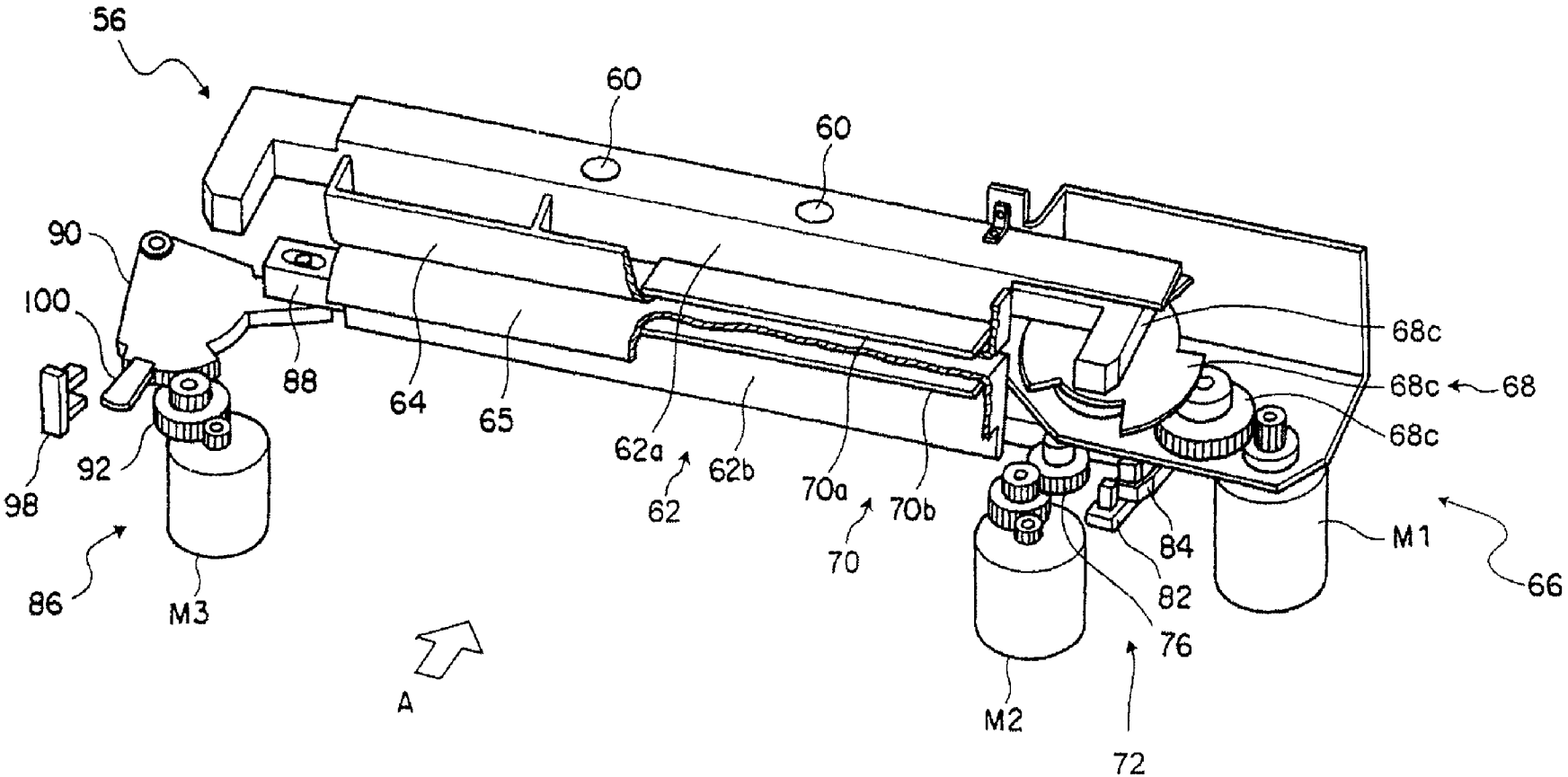
FIG. 2 is a schematic perspective view of the punch unit.
Figure 3:
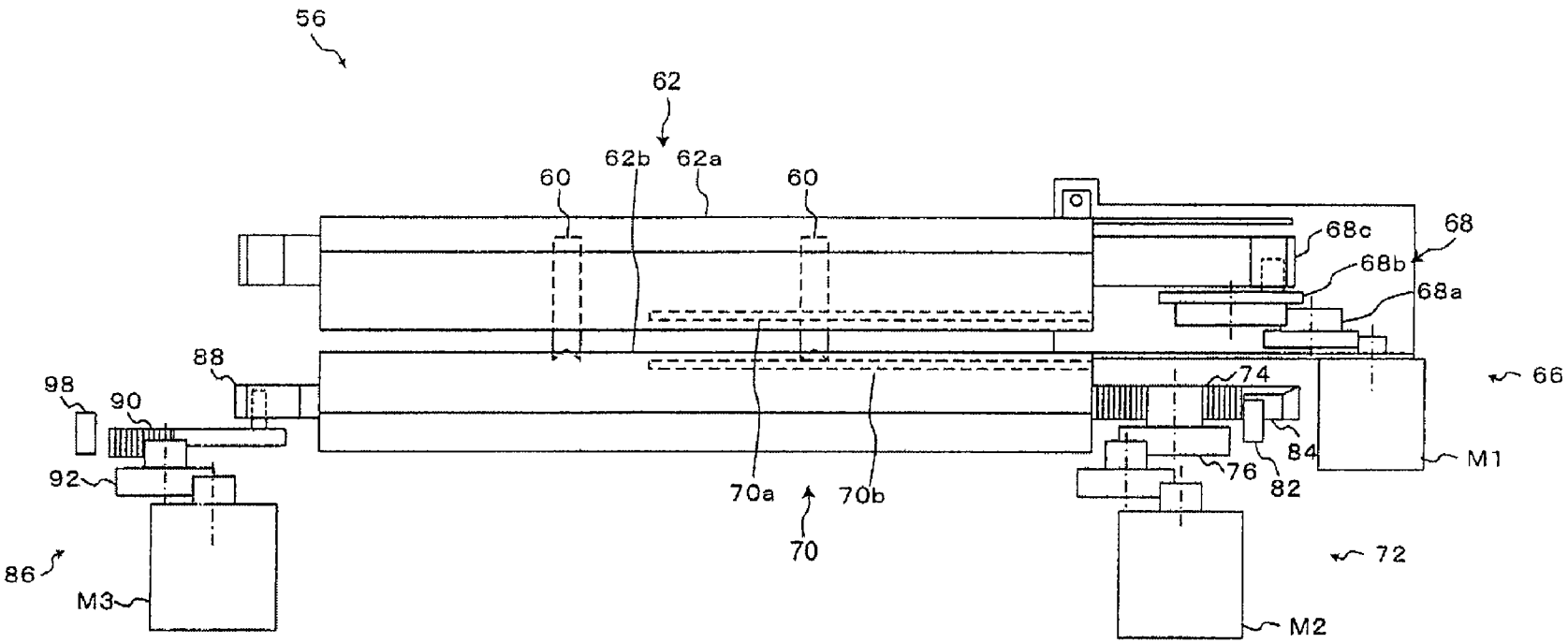
FIG. 3 is a schematic front view of the punch unit viewed in the direction of the arrow A shown in FIG. 2.
Figure 4:
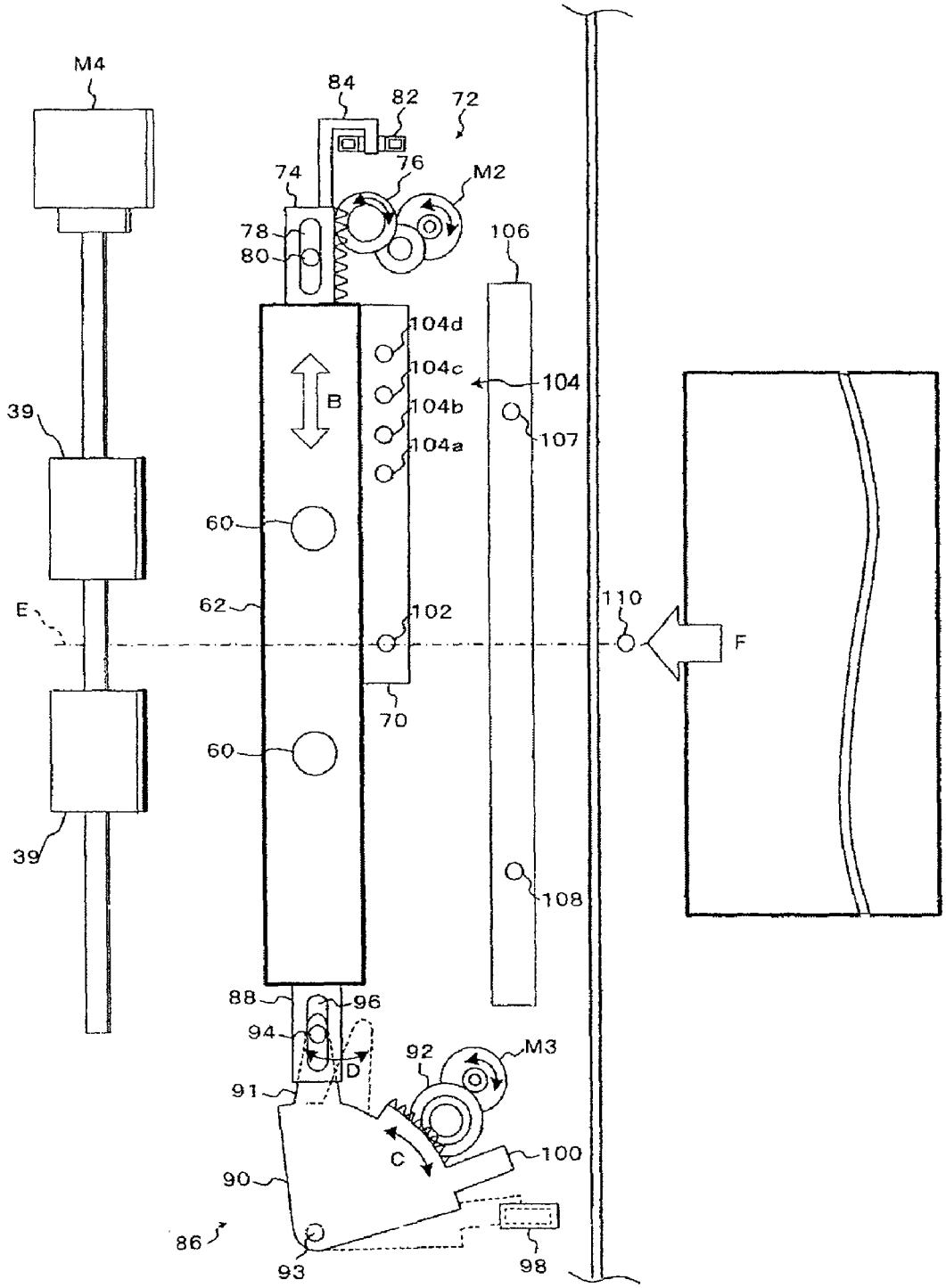
FIG. 4 is a schematic plan view of the punch unit shown in FIG. 2 viewed from above.

The punch unit 56 of the punch portion 37 will be explained. FIG. 2 is a schematic perspective view of the punch unit, and FIG. 3 is a schematic front view of the punch unit viewed in the direction of the arrow A shown in FIG. 2, and FIG. 4 is a schematic plan view of the punch unit shown in FIG. 2 viewed from above.

The punch unit 56 includes a plurality of punch heads 60 for punching sheets, a punching portion 62 in which the punch heads 60 are installed, a driving portion 66 for driving the punch heads 60, a lateral displacement adjuster 72 for moving the punching portion 62 and adjusting the punching position for a lateral slip of the sheets, and a skew adjuster 86 for adjusting the punching position for a skew of the sheets.

The punching portion 62 includes a support portion 62*a* for supporting the punch heads 60 and a receiving portion 62*b* having a hole for receiving the edge of the blade of each of the punch heads 60 during the punching process. To the support portion 62*a* and receiving portion 62*b* of the punching portion 62, guides 64 and 65 for guiding the conveyance of sheets are attached respectively. The punching portion 62 includes a light emitting portion 70*a* and a light receiving portion 70*b* arranged opposite to each other across the guides 64 and 65 and a sheet detecting portion 70 for detecting sheets passing between the light emitting portion 70*a* and the light receiving portion 70*b* is structured.

The driving portion 66 includes a DC motor M1 and power transmission members 68*a*, 68*b*, and 68*c* for transmitting the drive power of the DC motor M1 to the punch heads 60 and permitting them to perform the punching operation. In this embodiment, the punch heads 60 drive the surface of each sheet to move up and down by the rotation of the DC motor M1 and punch the sheets. The driving portion 66 is attached to the punching portion 62 and can move integrally with the punching portion 62.

The lateral displacement adjuster 72 adjusts the punching position for a slip of a sheet orthogonal to the sheet conveying direction of the punching portion 62 in the width direction (hereinafter, referred to as the lateral direction). The lateral displacement adjuster 72 includes a first horizontal member 74 attached at one end of the punching portion 62, a pinion gear 76, and a lateral register motor M2 which is a stepping motor. The first horizontal member 74 has a rack and via the pinion gear 76 fit into the rack, the power of the lateral register motor M2 is transmitted to the first horizontal member 74. In the first horizontal member 74, a first long hole 78 is formed. Into the first long hole 78, a fixing shaft 80 installed in the main body of the punch portion 37 is fit. Therefore, if the lateral register motor M2 is rotated, the punching portion 62 to which the first horizontal member 74 is attached, in the lateral direction using the fixing shaft 80 as a guide, that is, in the direction of the arrow B shown in FIG. 4, moves within the range of the length of the first long hole 78. The movement of the punching portion 62 in the lateral direction is controlled by the pulse number when driving the lateral register motor M2.

The lateral displacement adjuster 72 has a first HP sensor 82 for detecting the home position (hereinafter, referred to as the first HP) of the punching portion 62 in the sheet lateral direction. For the first HP sensor 82, a micro-sensor may be used. If a light interception member 84 projected to the first horizontal member 74 crosses the first HP sensor 82, the first HP sensor 82 detects that the punching portion 62 is positioned at the first HP. The movement distance of the punching portion 62 in the lateral direction, on the basis of the HP in the lateral direction detected by the first HP sensor 82, is controlled by the pulse number when driving the lateral register motor M2.

The skew adjuster 86 adjusts the punching position for the sheet skew (the inclination of the sheet orthogonal to the sheet conveying direction in the width direction, hereinafter, referred to as the vertical direction) of the punching portion 62. The skew adjuster 86 includes a second horizontal member 88 attached to the other end of the punching portion 62, a fan-shaped cam 90, a pinion gear 92, and a longitudinal register motor M3 which is a stepping motor. The cam 90 has a rack and if the power of the lateral register motor M2 is transferred to the pinion gear 92 fit into the rack, the cam 90 rotates at a fulcrum of a rotary shaft 93 installed on the main body of the punch portion 37.

The cam 90 has a projection portion 91 at one end on the side of the second horizontal member 88 and a shaft 94 is installed on the projection portion 91. On the second horizontal member 88, a second long hole 96 is formed and the shaft 94 is fit into the second long hole 96. Therefore, if the longitudinal register motor M3 rotates, the cam 90 rotates in the direction of the arrow C and the punching portion 62 to which the second horizontal member 88 is attached rotates at a fulcrum of the fixing shaft 80 in the longitudinal direction, that is, in the direction of the arrow D shown in FIG. 4. The rotation of the punching portion 62 in the longitudinal direction is controlled by the pulse number when driving the longitudinal register motor M3.

The skew adjuster 86 has a second HP sensor 98 for detecting the home position (hereinafter, referred to as the second HP) of the punching portion 62 in the sheet longitudinal direction. For the second HP sensor 98, a micro-sensor may be used and if a light interception member 100 projected to the other end of the cam 90 crosses the second HP sensor 98, the second HP sensor 98 detects that the punching portion 62 is positioned at the second HP. Therefore, the rotational angle of the punching portion 62 in the longitudinal direction, on the basis of the HP in the longitudinal direction detected by the second HP sensor 98, is controlled by the pulse number when driving the longitudinal register motor M3. The HP of the punching portion 62 in the lateral direction may be on a central line E of the conveying path arranged a leading/trailing edge sensor 102. The HP of the punching portion 62 in longitudinal direction may be inclined from the sheet width direction orthogonal to the sheet conveying direction.

The sheet detecting portion 70 includes the leading/trailing edge sensor 102 to detect the edges (leading edge and trailing edge) of a sheet in the conveying direction and a lateral edge sensor 104 to detect the edge (lateral edge) of a sheet in the conveying direction. The lateral edge sensor 104 has a plurality of sensors corresponding to the sheet size and includes, sequentially from the side of the leading/trailing edge sensor 102, a lateral edge sensor 104*a* corresponding to sheets of size B5-R, a lateral edge sensor 104*b* corresponding to sheets of size A4-R, a lateral edge sensor 104*c* corresponding to sheets of sizes B5, B4, 16K and 8K, and a lateral edge sensor 104*d* corresponding to sheets of sizes A4 and A3.

The punch unit 56 has a skew sensor 106 for detecting the skew of sheets on the upstream side of the punching portion 62 in the sheet conveying direction. The skew sensor 106 includes a first skew sensor 107 and a second skew sensor 108. For the first and second skew sensors 107 and 108, for example, similarly to the sensor of the sheet detecting portion 70, a sensor including a light emitting portion and a light receiving portion can be used. The first and second skew sensors 107 and 108 are arranged side by side in the sheet width direction orthogonal to an ideal sheet conveying direction so that the mutual distance is narrower than the width size of a minimum punchable sheet. The first and second skew sensors 107 and 108 are positioned at the same distance from the central line E of the conveying path. When a sheet passes between the first and second skew sensors 107 and 108, the sensors detect the skew of the sheet.

As shown in FIG. 4, a sheet sensor 110 is provided on the sheet conveying path of the image forming apparatus 1. For the sheet sensor 110, for example, similarly to the sensor of the sheet detecting portion 70 may be used a sensor including a light emitting portion and a light receiving portion. The sheet sensor 110 should just be in the conveying direction upper stream rather than the skew sensor 106. In this embodiment, although the sheet sensor 110 is located in the most downstream of the sheet conveying path, but it is not limited to this.

The conveyor motor M4 drives the first rollers 39 at a predetermined number of rotations. The first rollers 39 convey the sheets downward at a conveying speed V.

Figure 5:
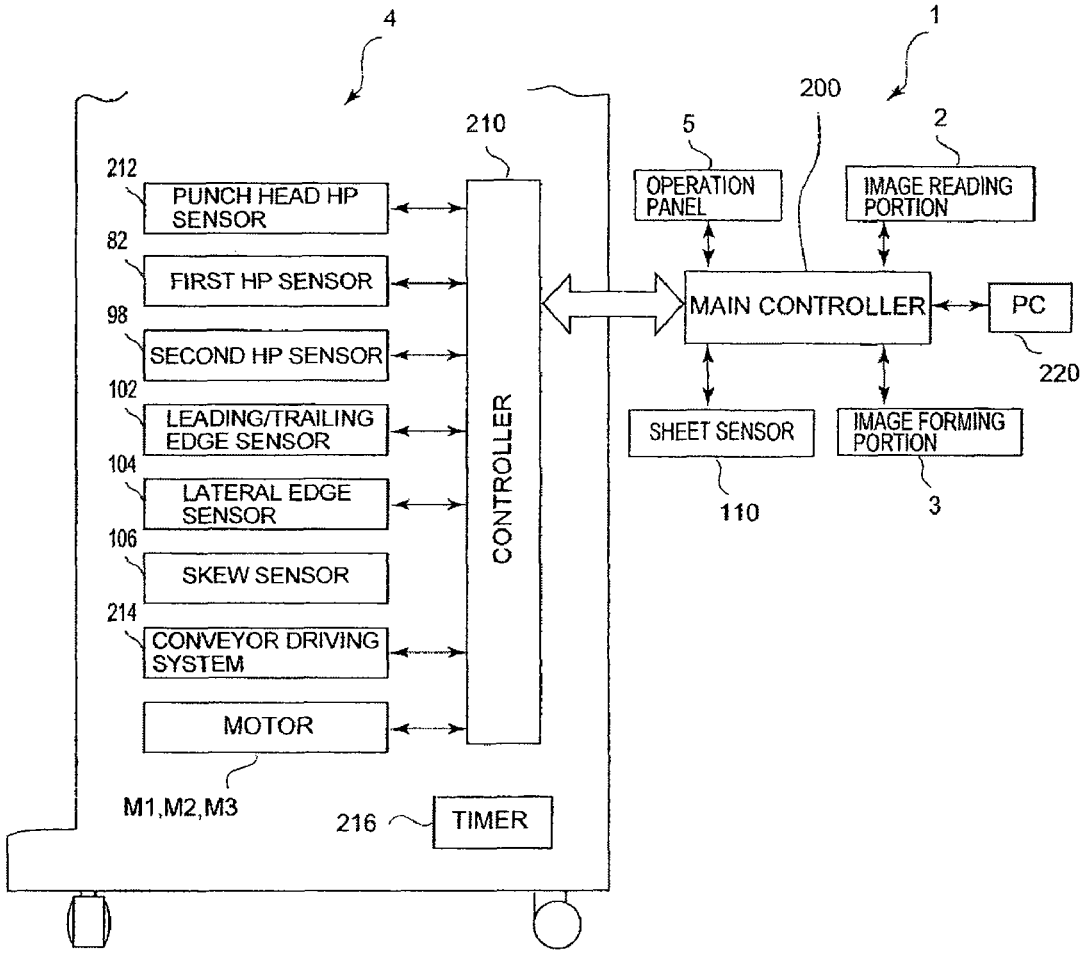
FIG. 5 is a schematic block diagram of the control system of the image forming apparatus and sheet processing apparatus.

FIG. 5 is a schematic block diagram of the control system of the image forming apparatus and sheet processing apparatus.

The image forming apparatus 1 has a main controller 200 for controlling the whole image forming apparatus 1. The main controller 200 synthetically controls the image reading portion 2, image forming portion 3, and a controller 210 for the operation panel 5 and sheet finishing apparatus 4. The main controller 200 performs the image process such as correction, compression, and expansion of image data, stores compressed image data and print data, and performs data communication with a PC (personal computer) 220 installed outside the image forming apparatus 1.

The controller 210 for the sheet finishing apparatus 4 includes a CPU and a memory and controls the first rollers 39, a conveyor driving system 214 including the conveyor motor M4, and various operations of the punching portion including the operations of the motors M1 to M3. To the controller 210, the first and second HP sensors 82 and 98, leading/trailing edge sensors 102, lateral edge sensor 104, skew sensor 106, and a punch head HP sensor 212 are connected and a signal from each sensor is sent to the controller 210. The punch head HP sensor 212 detects the home position when the punch heads 60 move up and down by the DC motor M1. The home position of the punch heads 60 is the status that the punch heads 60 are pulled out from the punched sheet, that is, is the position when the punch heads 60 are separated from the sheet surface. Further, a timer 216 which is a time measuring means is connected to the controller 210. The timer 216, on the basis of an instruction of the controller 210, when each sensor detects passing of sheets, starts time measurement.

Figure 6:
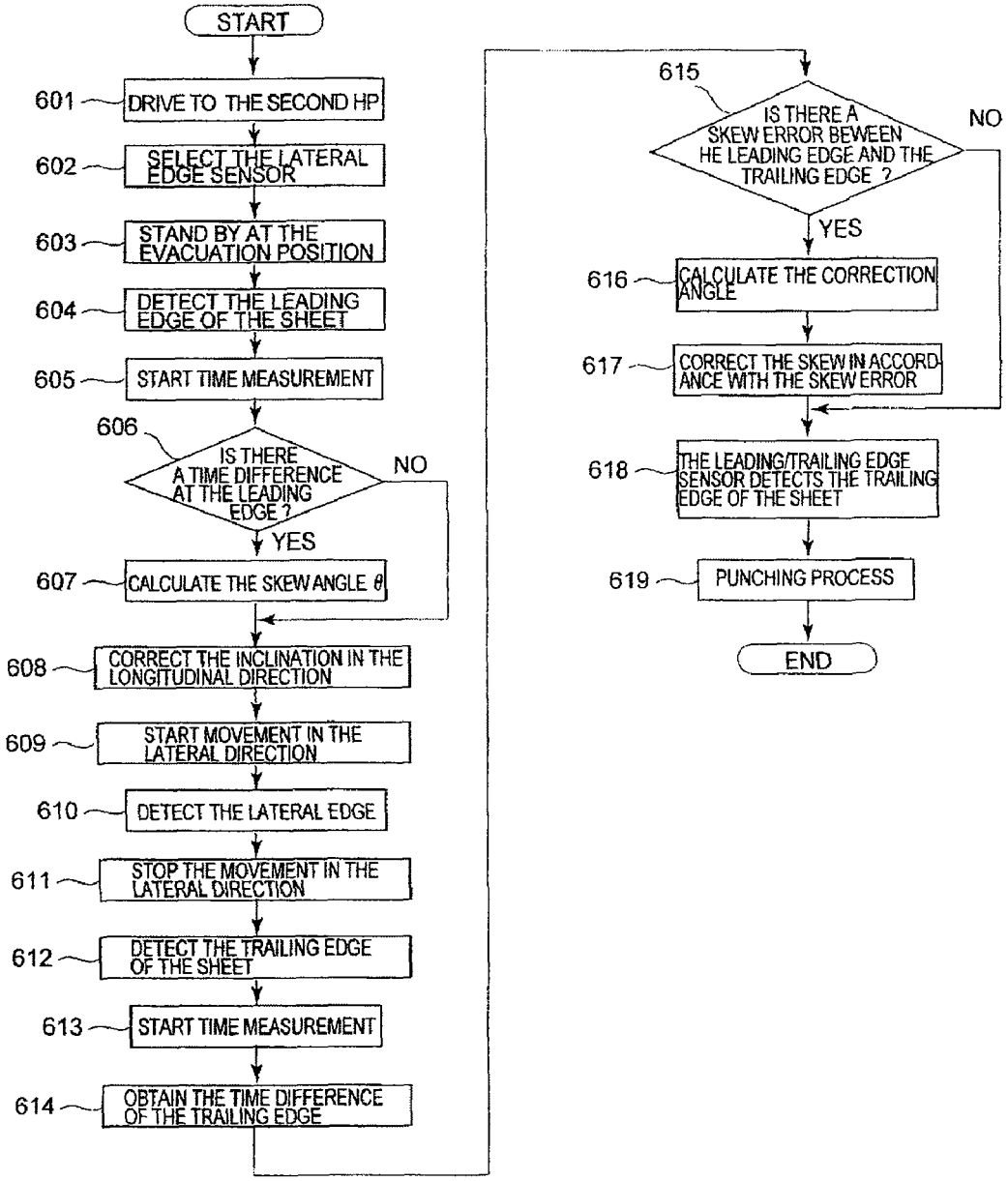
FIG. 6 is a flow chart showing an example of the operation of the sheet detection portion and skew sensor.

The sheet detecting portion 70 and skew sensor 106 will be explained by referring to FIG. 6. FIG. 6 is a flow chart for explaining an example of the operations of the sheet detecting portion 70 and skew sensor 106.

Upon receipt of an instruction of the punching process from the main controller 200 of the image forming apparatus 1, at 601, the controller 210 drives the longitudinal register motor M3, moves the punching portion 62 to the second HP, and inclines the punching portion 62 to the sheet width direction orthogonal to the sheet conveying direction. Further, the controller 210 obtains the information on the sheet kind which is input and conveyed by the operation panel 5 or PC 220 from the main controller 200. At 602, the controller 210, on the basis of the sheet kind information obtained, selects the lateral edge sensor 104 to be used. Then, the controller 210 drives the lateral register motor M2 and moves the punching portion 62 in the lateral direction separating from the center of the sheet conveying path. The controller 210, at 603, permits the lateral edge sensor 104 selected to stand by at the position (the position far away from the center of the sheet conveying path, hereinafter referred to as the evacuation position) furthermore outside the sheet conveying path than the lateral edge of the sheet conveyed. The sheet conveyed may be shifted in the lateral direction from the center of the conveying path, so that the evacuation position can be determined with a spare time.

If a sheet is conveyed at a conveying speed V from the image forming apparatus 1, at 604, the first and second skew sensors 107 and 108 detect respectively the leading edge of the sheet in the conveying direction (hereinafter, referred to as the sheet leading edge). At 605, the timer 216, at the timing that the first and second skew sensors 107 and 108 respectively detect the sheet leading edge, starts each time measurement. The controller 210, at 606, when the first and second skew sensors 107 and 108 detect the sheet leading edge, judges whether there is a time lag between the detection of the sheet leading edge by one sensor and the detection of the sheet leading edge by the other sensor or not. Therefore, when the sheet is not inclined at all to the conveying direction, the first and second skew sensors 107 and 108 simultaneously detect the sheet leading edge, so that no time lag is caused.

When a time lag is caused at 606, the controller 210, from the caused time lag and conveying speed V, obtains a skew error. At 607, from the skew error, the order of detection of the sheet leading edge by the first and second skew sensors 107 and 108, and the distance between the first and second skew sensors 107 and 108, the controller 210 obtains a skew angle θ. If the skew angle θ is obtained, the controller 210, at 608, drives to control the longitudinal register motor M3 by the pulse number so as to incline the punching portion 62 and corrects the skew according to the skew amount of the sheet. When the sheet is not skewed, the controller 210 drives to control the longitudinal register motor M3 by the pulse number so as to permit the punching portion 62 to cross the sheet conveying direction at right angles.

Next, the controller 210, at 609, starts to drive the lateral register motor M2 and the punching portion 62 starts the movement in the lateral direction from the evacuation position to the center of the sheet conveying path. The drive for the lateral register motor M2, depending on the timing, is executed before or after or in parallel with the processes at 601 to 607. At 610, the lateral edge sensor 104 detects the lateral edge of a sheet conveyed during movement in the lateral direction. The controller 210, from the detection position of the lateral edge of the sheet, drives the lateral register motor M2 by a predetermined pulse number specified for each sheet size. When the punching portion 62 moves to the punching position, the controller 210, at 611, stops the movement of the punching portion 62.

Then, at 612, the first and second skew sensors 107 and 108 detect respectively the trailing edge of the sheet in the conveying direction (hereinafter, referred to as the sheet trailing edge). The timer 216, at the timing that the first and second skew sensors 107 and 108 detect respectively the trailing edge of the sheet, starts each time measurement at 613. The controller 210, at 614, when the first and second skew sensors 107 and 108 detect the trailing edge of the sheet, obtains the time lag between the detection of the sheet leading edge by one sensor and the detection of the sheet leading edge by the other sensor. Then, the controller 210, at 615, judges whether there is an error between the time lag of the leading edge detected at 606 and the time lag of the leading edge detected at 614 or not, that is, judges whether there is an error between the skew amount of the sheet leading edge and the skew amount of the sheet trailing edge or not.

At 615, when there is an error, the controller 210, at 616, obtains a correction angle similarly to 607. At 617, the controller 210 drives to control the longitudinal register motor M3 by the pulse number so as to rotate at the correction angle, inclines the punching portion 62, and corrects the skew according to the skew error. At that time, the controller 210 drives the lateral register motor M2 according to the skew error and finely adjusts the punching portion 62 in the lateral direction.

At 618, when the leading/trailing edge sensor 102 detects the trailing edge of the sheet conveyed, the controller 210 furthermore controls the conveyor motor M4 by the predetermined pulse number, conveys the sheet to the position where the punching process is performed, and then stops the motor M4. When the conveyor motor M4 is stopped, the controller 210, at 619, drives the motor M1 and performs the punching process by the punch heads 60. When the punching process is completed, the controller 210 drives again the conveyor motor M4, discharges the processed sheet, and until the processing of the sheets of the number of job copies ends, repeats the aforementioned operation. When the process of the sheets during the job is all finished, the controller 210 permits the punching portion 62 to evacuate at each HP.

The motor M1 to move up down the punch heads 60 may starts to drive earlier than stop of the conveyor motor M4 in correspondence to the time required for the punch heads 60 from movement start to making contact with the sheet. To measure a time required for the punch head 60 from movement start to making contact with the sheet, the timer 216 may measure an elapsed time from the leading/trailing edge sensor 102 detects the trailing edge of the sheet. After the leading/trailing edge sensor 102 detects the trailing edge of the sheet, when the number of pulses for the conveyor motor M4 exceeds a fixed number, the motor M1 may start to drive. A memory may memorize beforehand data, such as the predetermined number of pulses specified according to sheet size, the number of pulses which drives each motor, and time for the timer 216 to measure.

At 609, when the controller 210 intends to control just using the leading/trailing edge sensor 102 as a trigger for starting to drive the lateral register motor M2, if the sheet length in the conveying direction is short or the sheet conveying speed V is high, the moving speed of the punching portion 62 in the lateral direction is restricted. Therefore, before the lateral edge sensor 104 detects the sheet trailing edge, the sheet may pass. Inversely, if the conveying speed V is made slow to prevent the sheet from passing or the punching portion 62 is stopped temporarily, the processing performance gets worse.

In this embodiment, depending on the sheet kind or conveying speed, the trigger of drive start of the lateral register motor M2 is changed, and drive timing is provided accurately, thus the punching portion 62 is driven.

As an example, Table 1 shows the experimental results when the sheet size is assumed as A4, A4-R, A3, B5, B5-R, B4, 16K and 8K, and the conveying speed is assumed as 400, 600, 800, 1000 and 1200 mm/s, and as a drive start trigger of the lateral register motor M2, the leading/trailing edge sensor 102, skew sensor 106, and sheet sensor 110 installed in the sheet conveying path of the image forming apparatus 1 are used. A symbol O indicates processable and x indicates unprocessable. The controller 210, during the period from detection of the leading edge of the sheet by the sensor selected as a trigger of drive start of the lateral register motor M2 to passing of the sheet trailing edge through the judgment standard position, judges whether the lateral edge sensor 104 can detect the lateral edge of the sheet or not. Table 1 shows the results, as an example, obtained when the skew sensor 106 is used at the judgment standard position.

As shown in Table 1, when the leading/trailing edge sensor 102 is used as a trigger of drive start of the lateral register motor M2, up to the conveying speed 600 mm/s, all the sheet sizes can be processed. However, at the conveying speed 800 mm/s or higher, the sheet sizes A4, B5, and 16K cannot be processed and at the conveying speed 1200 mm/s, the sheet size B5-R cannot be processed.

When the skew sensor 106 positioned on the upstream side of the leading/trailing edge sensor 102 in the conveying direction is used as a trigger of drive start of the lateral register motor M2, compared with the case that the leading/trailing edge sensor 102 is used, the sheets sizes A4, B5, and 16K at the conveying speed 800 mm/s and the sheet size B5-R at the conveying speed 1200 mm/s can be respectively processed newly. The skew sensor 106, when a sheet is skewed, uses either of the first and second skew sensors 107 and 108 which detects it earlier.

When using the sheet sensor 110 positioned on the upstream side of the skew sensor 106 in the conveying direction, up to the conveying speed 1200 mm/s experimented, all the sheet sizes can be processed.

TABLE

| | Speed (mm/sec) | A4 | B5 | 16K | A3 | B4 | 8K | A4-R | B5-R |
|---|---|---|---|---|---|---|---|---|---|
| Sheet length | | 210 | 182 | 195 | 420 | 364 | 390 | 297 | 257 |
| Leading/trailing | 400 | ○ | ○ | ○ | ○ | ○ | ○ | ○ | ○ |
| edge sensor | 600 | ○ | ○ | ○ | ○ | ○ | ○ | ○ | ○ |
| used as a trigger | 800 | x | x | x | ○ | ○ | ○ | ○ | ○ |
| | 1000 | x | x | x | ○ | ○ | ○ | ○ | ○ |
| | 1200 | x | x | x | ○ | ○ | ○ | ○ | x |
| Skew detection | 400 | ○ | ○ | ○ | ○ | ○ | ○ | ○ | ○ |
| portion used as | 600 | ○ | ○ | ○ | ○ | ○ | ○ | ○ | ○ |
| a trigger | 800 | ○ | ○ | ○ | ○ | ○ | ○ | ○ | ○ |

TABLE-continued

| Speed (mm/sec) | A4 | B5 | 16K | A3 | B4 | 8K | A4-R | B5-R |
|---|---|---|---|---|---|---|---|---|
| 1000 | x | x | x | ○ | ○ | ○ | ○ | ○ |
| 1200 | x | x | x | ○ | ○ | ○ | ○ | ○ |

Neither conveying speed nor sheet size is limited to what is shown above.

For example, sheets conveyed at the conveying speed V are processed using any of the selectable sensors as a trigger. Therefore, the relationship between the selected sensors and the conveying speed V [m/s], assuming the judgment standard position, for example, the distance from the skew sensor 106 to the sensor selected as a trigger as X [m], the distance from the evacuation position until detection of the sheet lateral edge by the lateral edge sensor 104 as X1 [m], the moving speed of the lateral edge sensor 104 as V1 [m/s], and the sheet length in the conveying direction as L [m], meets the following formula.

[Formula 1]

$$\frac{X+L}{V} > \frac{X_1}{V_1} \qquad \text{Formula 1}$$

However, the distance X is taken as positive when the position of the sensor selected as a trigger is on the upstream side of the judgment standard position in the conveying direction and as negative when it is on the downstream side. For example, when the judgment standard position is the position of the skew sensor 106, if the trigger is the skew sensor 106, X is zero and if the trigger is the leading/trailing edge sensor 102, X is negative.

The moving speed V1 of the lateral edge sensor 104 may not be regular. The moving speed V1 of the lateral edge sensor 104 may use the average speed when after several pulses from movement start, the speed reaches the maximum moving speed and the sensor detects the lateral edge of the sheet at the maximum moving speed.

The distance X1 may have a margin for a shift in a traverse direction from the center of the conveying path of the sheet. The distance X1 may not be the distance which will actually move by the time the lateral edge sensor 104 detects the horizontal edge of the sheet from the evacuation position. When calculating the distance X1, the value assumed to be the distance which moves until the lateral edge sensor 104 detects the lateral edges of the sheet from the evacuation position should just be used for it.

The maximum conveying speed $V_{max}$ processable, when the distance from the sensor positioned on the most upper stream side in the conveying direction among the sensors selectable as a trigger to the skew sensor 106 is assumed as $X_{max}$, is within the range of the following formula.

[Formula 2]

$$\frac{X_{max}+L}{V_{max}} > \frac{X_1}{V_1} \qquad \text{Formula 2}$$

Therefore, the controller 210 conveys sheets so that the sheet conveying speed becomes the maximum conveying speed $V_{max}$ meeting Formula 2 or lower. When the sensor selected as a trigger is a sensor on the conveying path in the image forming apparatus 1 and the sheet conveying speed in the image forming apparatus 1 is different from the sheet conveying speed up to the judgment standard position in the punch portion 37, for example, the mean value of both conveying speeds may be used. In this case, the mean value of the conveying speeds must meet Formula 2.

The controller 210 may judge whether the lateral edge sensor 104 is able to detect the lateral edge of the sheet based on the data stored in the memory etc. according to the distance between each sensor, and conveying speed and sheet size. The controller 210 may judge whether the lateral edge sensor 104 is able to detect the lateral edge of the sheet based on formula, such as the Formula 1 and the Formula 2.

The judgment standard position is not limited to the sensor and member such as the skew sensor 106. For example, it may be positioned as a value used for calculation on the upstream side or the downstream side of the skew sensor 106. Namely, the judgment standard position may be decided depending on the required processing performance.

For example, as mentioned above, when the skew sensor 106 detects the trailing edge of the sheet at 615, the error from that at the time of detection of the leading edge is adjusted. When the judgment standard position is located at upstream position from the skew sensor 106, skew correction can be performed immediately if the skew sensor 106 detects the trailing edge of the sheet.

Figure 7:
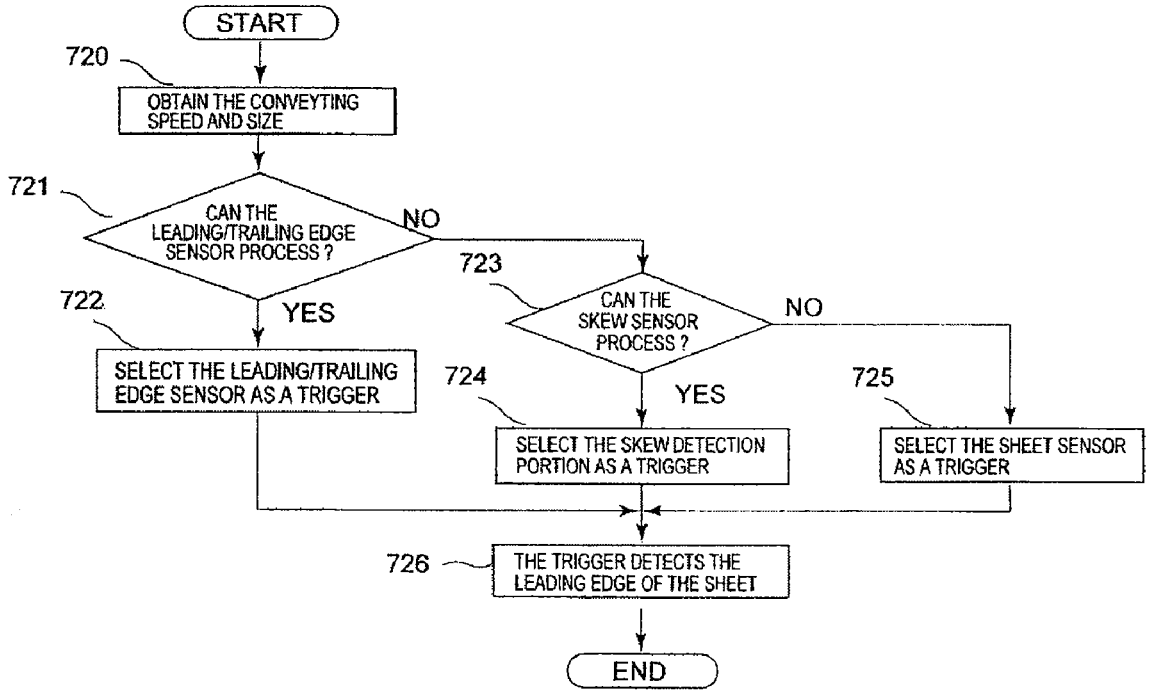
FIG. 7 is a flow chart showing an example of the punch processing operation.

An example of the operation of the punching process when the skew sensor (the first detector) 106, leading/trailing edge sensor (the second detector) 102, sheet sensor (the third detector) 110, and lateral edge sensor (the edge detector) 104 are used will be explained by referring to the flow chart shown in FIG. 7. For the respective operations explained in FIG. 6, detailed explanation will be omitted.

Upon receipt of an instruction of the punching process from the main controller 200 of the image forming apparatus 1, the controller 210 obtains various information of the punching process from the image forming apparatus 1 from the main controller 200. The controller 210, at 720, obtains the information on the sheet conveying speed V and sheet length L in the conveying direction from the received information.

The controller 210, at 721, judges whether the obtained conveying speed V, in the obtained sheet size, among the selectable sensors, can be processed by the leading/trailing edge sensor 102 positioned on the most downstream side in the sheet conveying direction or not. When it can be processed by the leading/trailing edge sensor 102, the controller 210, at 722, selects the leading/trailing edge sensor 102 as a trigger of drive start of the lateral register motor M2.

On the other hand, when the controller 210 judges at 721 that it cannot be processed by the leading/trailing edge sensor 102, the controller 210, at 723, judges whether the obtained conveying speed V, in the obtained sheet size, among the selectable sensors, can be processed by the skew sensor 106 positioned on the upper stream side of the leading/trailing edge sensor 102 in the conveying direction or not. When it can be processed by the skew sensor 106, the controller 210, at 724, selects the skew sensor 106 as a trigger of drive start of the lateral register motor M2. When the controller 210 judges at 723 that it cannot be processed by the skew sensor 106, the controller 210, at 725, selects the sheet sensor 110 positioned on the upstream side of the skew sensor 106 in the conveying direction as a trigger of drive start of the lateral register motor M2.

Then, at 726, when the sensor selected as a trigger detects the leading edge of a sheet, the controller 210 starts to drive the lateral register motor M2. Hereinafter, the process can be performed similarly to Step 609.

According to the sheet finishing apparatus 4 aforementioned, depending on the sheet kind or conveying speed, the trigger of drive start of the lateral register motor M2 is changed and the drive start timing from the evacuation position can be obtained accurately. Therefore, even if the sheet conveying speed is increased, the lateral edge of the sheet can be detected surely, so that the punching process can be speeded up and the performance can be improved.

Particularly, when the judgment standard position is defined as the skew sensor 106 or a position on the upper stream side, after the skew sensor 106 detects the trailing edge of the sheet, the skew can be corrected immediately, so that the performance of the punching process is good.

Further, the controller 210 can perform the punching process always in the optimum processing time.

The sheet finishing apparatus 4 aforementioned not only advances the drive timing of the punching portion 62 but also automatically selects an optimum sensor as a trigger and after the sensor selected as a trigger detects the leading edge of a sheet, starts movement of the punching portion 62 in the lateral direction. Namely, even if the sheet conveying speed V is low, there is no fear that the drive start timing is too early, thus the lateral edge sensor may be shifted furthermore inside the sheet conveying path than the sheet lateral edge. Therefore, even if the image forming apparatus 1 is operated at a high speed or a low speed, the performance of the image forming apparatus 1 will not be lowered and the apparatus can be processed optimally in accordance with the performance.

The sheet sensor 110 may be in the sheet conveying path in the image forming apparatus 1 which is in the conveying direction upper stream rather than the skew sensor 106. The sheet sensor 110 may be the conveying direction upper stream from the skew sensor 106. The sheet sensor 110 may be in the sheet conveying path in the punch portion 37.

When the sheet sensor 110 is not used, a trigger may be selected from the leading/trailing edge sensor 102 and skew sensor 106. Inversely, as a sensor selectable as a trigger, for example, a plurality of sheet sensors 110 may be provided along the sheet conveying path.

The leading/trailing edge sensor 102 may have more than one. The leading/trailing edge sensor 102 may include the sensor which detects a leading edge of the sheet, and the sensor which detects the trailing edge of the sheet. The sensor which detects the leading edge of the sheet may be a sensor which can be chosen as a trigger.

(Second Embodiment) The second embodiment will be explained. Hereinafter, to the same parts as those indicated in the first embodiment, the same numerals are assigned and only the characteristic parts of this embodiment will be explained.

The punching portion 62, when performing the punching process for sheets, repeats the following movement. One of them is the operation of moving in the lateral direction from the evacuation position to the center of the conveying path and detecting the lateral edge of a sheet. Another one is the operation of punching a sheet at the punching position. Still another one is the operation of moving from the punching position to the evacuation position.

Therefore, the image forming cycle of the image forming apparatus 1 is improved more and if the sheet conveying speed V is increased or the sheet conveying interval is narrowed, for example, before moving from the punching position to the evacuation position, the succeeding sheet may be carried in.

For example, the image forming apparatus 1 and the sheet finishing apparatus 4 are attached and the sheet feeder 30 in the image forming apparatus 1 and the conveying path 31 are attached, thus sheets conveyed to the punching portion 62 may be shifted from the center of the conveying path. Therefore, if a design allowing the shift is used, for example, the distance from the evacuation position until the punching portion 62 moves in the lateral direction toward the center of the conveying path and detects the lateral edge of a sheet may be longer than its original one.

Figure 8:
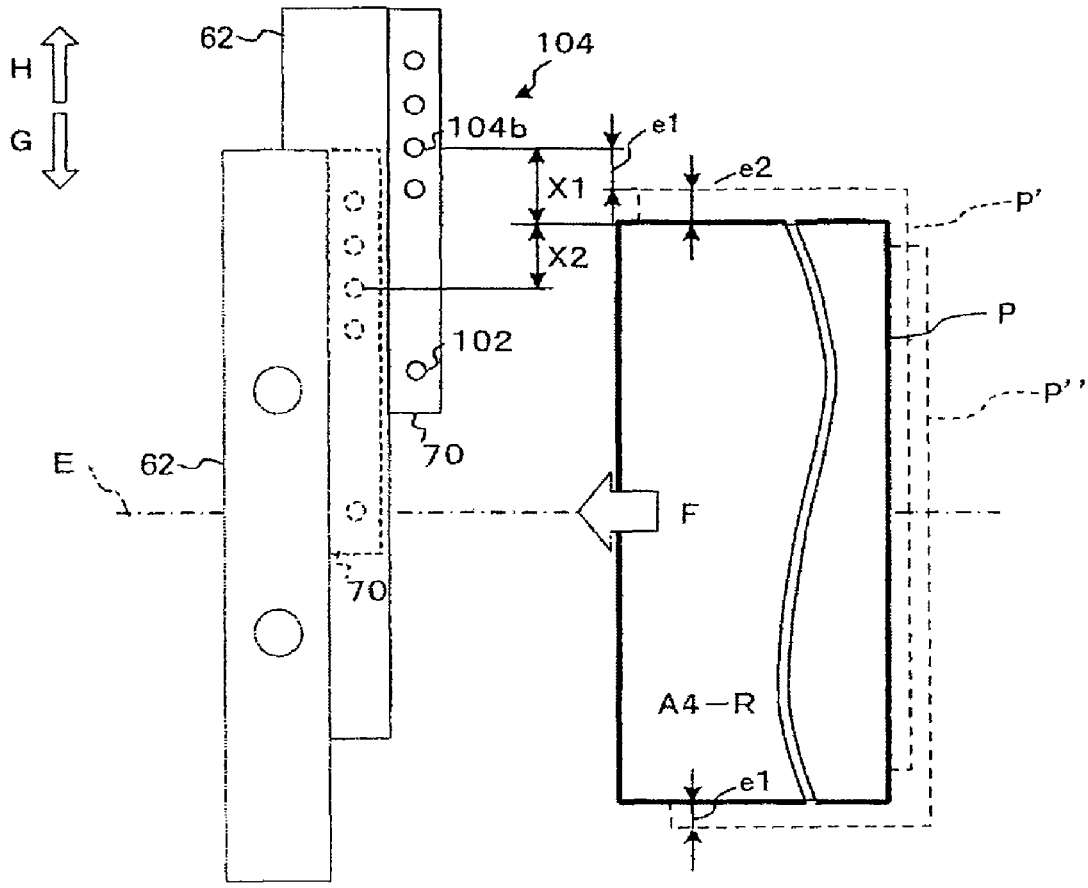
FIG. 8 is a schematic view showing an example of the relationship between the evacuation position of the punching portion and the punching position thereof.

FIG. 8 is a schematic view showing an example of the relationship between the evacuation position of the punching portion 62 and the punching position. The punching portion 62 drawn by a dotted line indicates the one at the punching position. The punching portion 62 drawn by a solid line indicates the one at the evacuation position. The punching portion 62, for simplicity of explanation, is in the state that the shaft in the sheet conveying direction is shifted.

A symbol P indicates a sheet conveyed ideally on the center of the sheet conveying path, and P' indicates a sheet shifted from the center of the sheet conveying path toward the evacuation position, and P" indicates a sheet shifted from the center of the sheet conveying path toward the opposite side of the evacuation position.

A symbol X1 shown in FIG. 8 indicates the movement distance from the evacuation position until detection of the lateral edge of a sheet by the lateral edge sensor 104. X2 indicates the distance from the position where the lateral edge sensor 104 detects the lateral edge of the sheet to the punching position to which the punching portion 62 moves. In FIG. 8, as an example, each movement distance is shown on the basis of the lateral edge sensor 104*b*.

The lateral edge sensor 104 detects the lateral edge of a sheet moved and conveyed from the evacuation position toward the center of the conveying path. Therefore, the evacuation position is designed so as to be set furthermore outside the conveying path by a distance of e1 than the lateral edge of the sheet. The punching portion 62, even if a sheet conveyed is shifted in the lateral direction from the center of the conveying path, so as to be able to perform the punching process, is designed with an error of e2 at its maximum allowed. Therefore, the sheet P, on the basis of the center of the conveying path, is allowed to shift by e2 in the directions of the arrows G and H in the lateral direction.

Therefore, the distance X1, assuming a shift on the basis of the sheet P conveyed ideally on the center of the sheet conveying path as ex, is expressed by the following formula.

[Formula 3]

$$X1=e1+e2-ex \qquad \text{Formula 3}$$

However, a shift in the direction of the arrow G on the basis of the sheet P or the center line E is assumed as negative and a shift in the direction of the arrow H is assumed as positive.

The distance X2 is a value specified by the size of a sheet conveyed and from the position where the lateral edge sensor 104 detects the lateral edge of the sheet, the lateral register motor M2 drives the punching portion 62 at a predetermined pulse number.

However, in consideration of the maximum error e2 in the direction of the arrow H, when deciding beforehand the evacuation position as a fixed position, assuming the distance from the ideal punching position for punching the sheet to the evacuation position as Y, the punching portion 62 moves to the evacuation position meeting the following formula for each punching process.

[Formula 4]

$$Y=X2+e1+e2 \quad \text{Formula 4}$$

For example, the case that a sheet is conveyed in the state that it is shifted by e2 from the center of the sheet conveying path in the direction of the arrow G is considered. Firstly, the punching portion 62 moves from the evacuation position meeting Formula 4 in the direction of the arrow G. The sheet P" is shifted by e2 in the direction of the arrow G, so that from Formula 3, if the punching portion 62 moves through the distance X1 meeting the following formula:

[Formula 5]

$$X1=e1+e2+e2 \quad \text{Formula 5}$$

the lateral edge sensor 104 detects the lateral edge of the sheet P". The punching portion 62 stops at the position where it moves furthermore through the distance X2 from the lateral edge detection position and performs the punching process for the sheet. Therefore, the distance Y' through which the punching portion 62 moves from the evacuation position to the punching position is expressed as indicated below.

[Formula 6]

$$Y'=X2+e1+2\cdot e2 \quad \text{Formula 6}$$

Then, when performing the punching process, the punching portion 62 moves through the same distance Y' to the evacuation position. Namely, the punching portion 62 moves an error 2xe2 more on one way between the evacuation position and the punching position.

However, a shift of a sheet from the center of the sheet conveying path is caused often by attaching the image forming apparatus 1 and the sheet finishing apparatus 4 or attaching the sheet feeder 30 in the image forming apparatus 1 and the conveying path 31. Therefore, for example, there is very few fear that the shift may be changed greatly during one job.

Therefore, instead of the evacuation position decided beforehand for each sheet, a new evacuation position is decided during execution of the punching process and the movement of the punching portion 62 is controlled.

Figure 9:
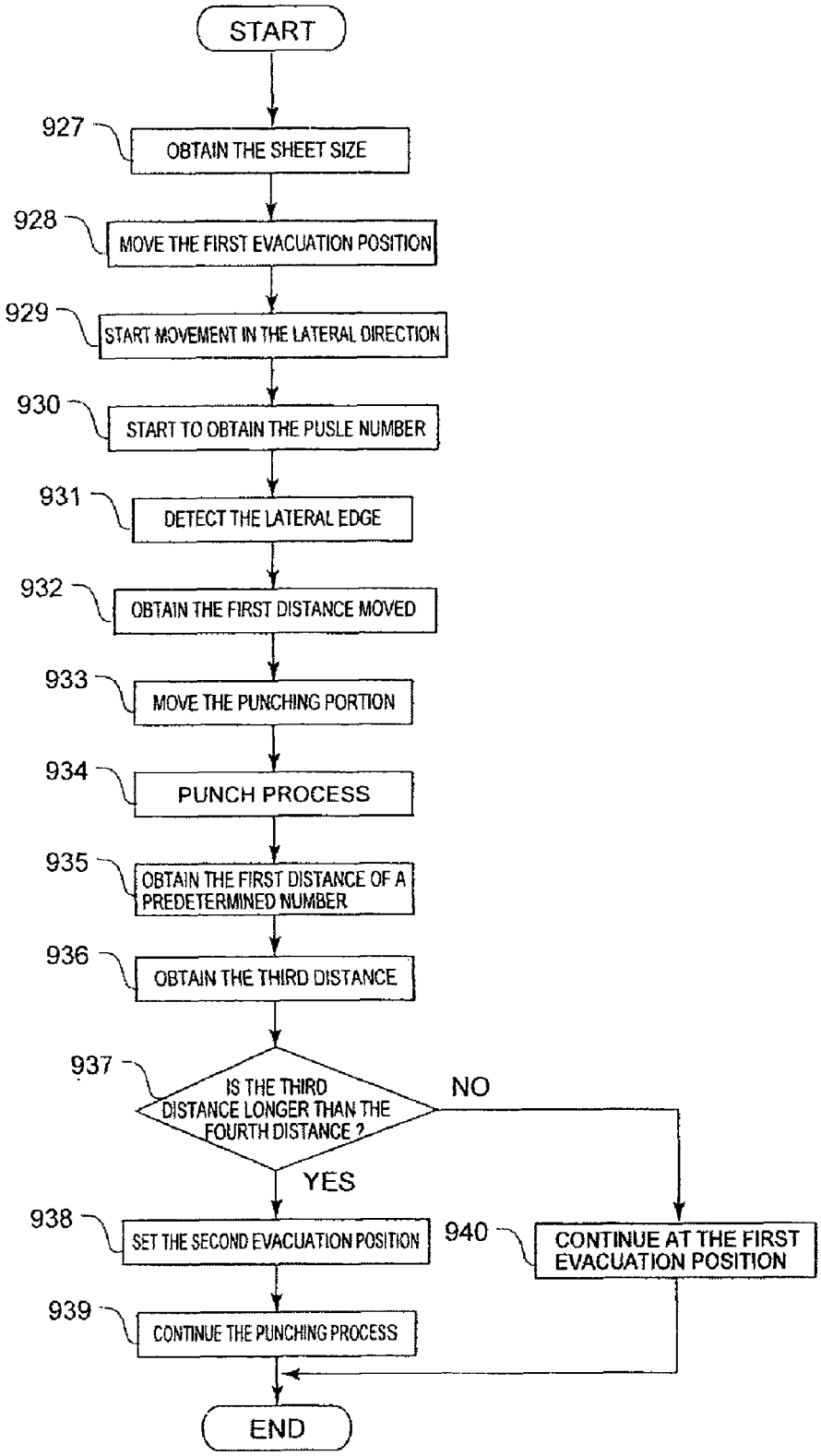
FIG. 9 is a flow chart showing an example of the movement control of the punching portion in the lateral direction.

FIG. 9 is a flow chart showing an example of the movement control of the punching portion in the lateral direction.

Upon receipt of an instruction of the punching process from the main controller 200 of the image forming apparatus 1, the controller 210, from the main controller 200, obtains various information of the punching process from the image forming apparatus 1. The controller 210, at 927, from the obtained information, obtains the information of the sheet length (hereinafter, referred to as the sheet width) in the lateral direction.

Then, at 928, on the basis of an instruction from the controller 210, the punching portion 62 moves and stands by at the evacuation position (the first evacuation position) meeting Formula 4. The punching portion 62, at 929, upon receipt of an instruction of start of lateral edge detection from the controller 210, starts movement in the lateral direction from the evacuation position toward the center of the sheet conveying path. Simultaneously, the controller 210, at 930, starts to obtain the pulse number for driving the lateral register motor M2. Further, at 931, the lateral edge sensor 104 of the punching portion 62, at the position where it moves through the distance X1 (the first distance) given in Formula 3 from the evacuation position, detects the lateral edge of a sheet.

The controller 210, at 932, obtains the distance X1 through which the lateral edge sensor 104 moves from the evacuation position until detection of the lateral edge of a sheet or the pulse number (the first pulse number) for driving the lateral register motor M2 for permitting the punching portion 62 to move through the distance X1. Further, the controller 210, at 933, from the detection position of the lateral edge of the sheet, furthermore drives the lateral register motor M2 by a predetermined pulse number (the second pulse number) specified for each sheet size and permits the punching portion 62 to move through the distance X2 (the second distance). When the punching portion 62 moves through the distance X2, and the skew is corrected, and the punching portion 62 is stopped at the punching position, the controller 210, at 934, drives the motor M1 and performs the punching process with the punch heads 60.

The controller 210 performs the aforementioned operation predetermined times and at 935, obtains a predetermined first distance or a predetermined first pulse number. Further, when the controller 210, at 936, obtains the predetermined first distance or the predetermined first pulse number, as a mean value or a minimum value of the first distance or the first pulse number, obtains the third distance or the third pulse number for moving the punching portion 62 through the third distance.

Then, the controller 210, at 937, judges whether the third distance or the third pulse number is larger than a predetermined distance e1 (the fourth distance or fourth pulse number) necessary to detect the lateral edge of a sheet or not. Namely, the controller 210 judges whether the third distance (or the third pulse number) X3 meets the following formula or not.

[Formula 7]

$$X3=e1+e2-ex>e1 \quad \text{Formula 7}$$

At 937, when the third distance or the third pulse number is larger than the fourth distance or the fourth pulse number, the controller 210, at 938, sets newly the second evacuation position toward the center of the sheet conveying path than the first evacuation position. The controller 210, at 939, permits the punching portion 62 to move up to the second evacuation position and continues the punching process. The distance from the second evacuation position to the sheet lateral edge detection position is preferably larger than the fourth distance or the fourth pulse number.

On the other hand, at 937, when the third distance or the third pulse number is smaller than the fourth distance or the fourth pulse number, the controller 210, at 940, continues the punching process with the evacuation position of the punching portion 62 kept at the first evacuation position.

The second evacuation position, for example, may be reset for each job or may be reset for each predetermined number of sheets during one job or for each predetermined number of sheets.

According to the sheet finishing apparatus 4 of the second embodiment, the controller 210, during execution of the sheet punching process, can set the second evacuation position closer to the center of the sheet conveying path than the first evacuation position. Therefore, the movement distance of the punching portion 62 is reduced, so that the controller 210 can respond to the punching process for sheets conveyed at a high speed and the performance can be improved. Further, even if sheets are conveyed in the shifted state, the punching portion 62 starts the movement for lateral edge detection from the optimum evacuation position and can save unnecessary movement.

Further, when sampling the process at the first evacuation position several times, the second evacuation position can be set more precisely.

Further, the distance X1 from the evacuation position up to the position where the lateral edge sensor 104 detects the lateral edge of a sheet is changed, so that by combination with the first embodiment, as clearly shown in Formula 1, the punching process can be speeded up more and the performance can be improved.

Instead of the judgment at 937, the distance from the second evacuation position to the position of lateral edge detection may be a half of the third distance and the third number of pulses which are obtained at 936. The distance from the second evacuation position to the position of lateral edge detection may be one divided by an integer of the third distance and the third number of pulses which are obtained at 936.

Figure 10A:
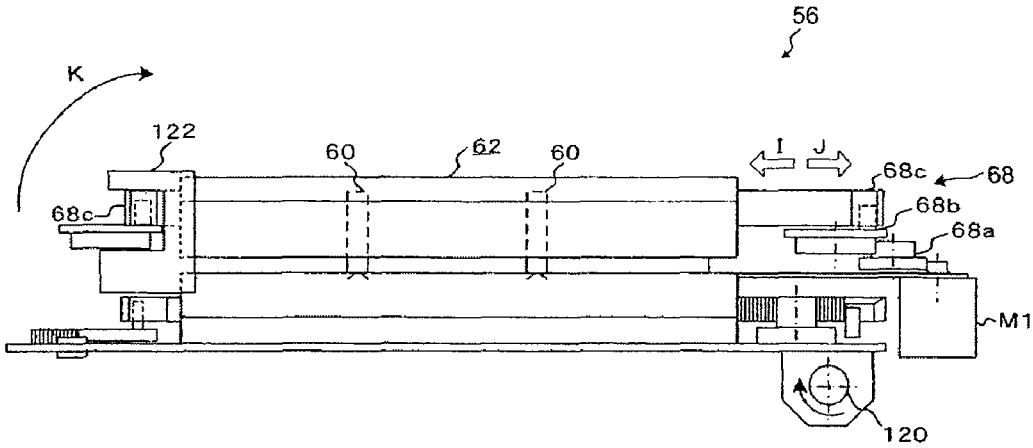
FIGS. 10A to 10C are schematic views for explaining another example of the punching portion.
Figure 10B:
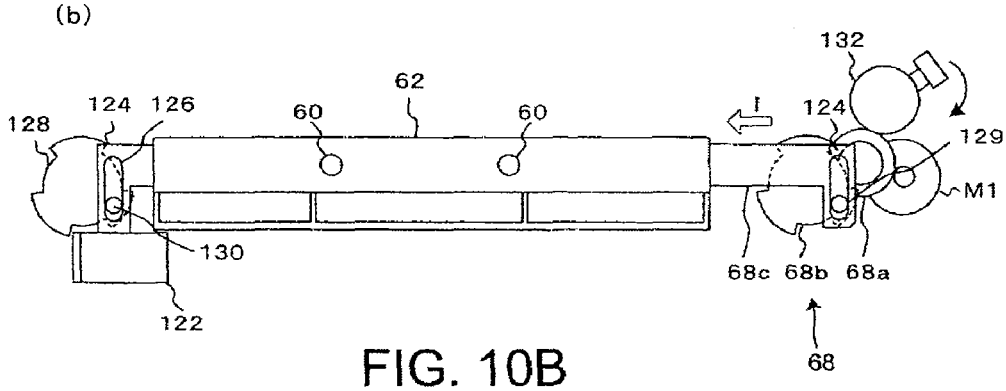
Figure 10C:
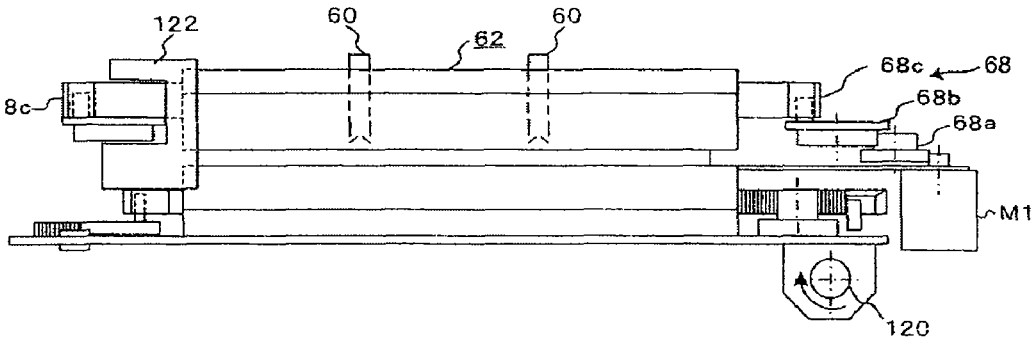

(Third Embodiment) FIGS. 10A to 10C are schematic views for explaining another example of the punching portion 62. Hereinafter, to the same parts as those indicated in the embodiments aforementioned, the same numerals are assigned and only the characteristic parts of this embodiment will be explained.

As shown in FIG. 10A, in the punch unit 56, after the punching portion 62 is stopped at the punching position, the punch heads 60 punch sheets. Further, the punch heads 60 obtain power from the DC motor M1 of the driving portion 66 and the power transmission member 68*c* moves alternately in the directions of the arrows I and J, thereby moves up and down and drives to punch the surface of each sheet.

If a jam occurs when the punch heads 60 are moved down, the punch portion 37 of the sheet finishing apparatus 4, to cancel the jam, must open the main body and rotate the punch unit 56 in the direction of the arrow K at a fulcrum of the rotary shaft 120. However, in the punch portion 37, the first rollers 39 may press down a sheet on the downstream side of the punching portion 62 in the conveying direction, and when the punch heads 60 are moved down, there is a fear of tearing the sheet. Therefore, when the punch heads 60 are pulled out from the sheet, for example, after the punch heads are returned to the home position, it is necessary to rotate the punch unit 56 in the direction of the arrow K.

Therefore, as shown in FIG. 10B, a binding member (prevention member) 122 for preventing the punch unit 56 when the punch heads 60 are moved down from rotation is installed. FIG. 10B is a plan view of the punching portion shown in FIG. 10A viewed from above. FIG. 10C is a front view showing the state that the punch heads are moved up.

The binding member 122, at the position where the movement of the power transmission member 68*c* in the directions of the arrows I and J is not disturbed, for example, is attached to the main body of the punch portion 37. In FIGS. 10B and 10C, as an example, the binding member 122 is arranged on the opposite side of the rotary shaft 120 across the punching portion 62.

One end and the other end of the power transmission member 68*c* where the driving portion 66 is arranged, for example, have a projecting portion 124 bent in an L shape in the sheet conveying direction. At the other end of the power transmission member 68*c*, a cam 128 for guiding the movement of the power transmission member 68*c* in the direction of the arrow I is arranged. In the projecting portion 124, a long hole 126 is formed. In the long hole 126, the power transmission member 68*b* and shafts 129 and 130 installed on the cam 128 are fit.

The binding member 122, when the punch heads 60 are moved down, for example, joins to the projecting member 124 of the power transmission member 68*c* and prevents the punch unit 56 from rotation in the direction of the arrow K. When the power unit 56 can rotate in the direction of the arrow K, for example, upward, the binding member 122 is arranged so as to press down the upper part of the power transmission member 68*c*.

On the other hand, the binding member 122, when the punch heads 60 are moved up, does not always control the rotation of the punch unit 56. For example, as shown in FIG. 10C, when the punch heads 60 are moved up, the joint to the power transmission member 68*c* is canceled.

The position of the power transmission member 68*c* when the punch heads 60 are moved down is assumed as a first position and the position of the power transmission member 68*c* when the punch heads 60 are moved up is assumed as a second position. Namely, the binding member 122, when the punch heads 60 are moved down, for example, when the power transmission member 68*c* is set at the first position, prevents the punch unit 56 from rotation in the direction of the arrow K. Further, the binding member 122, when the punch heads 60 are moved up, for example, when the power transmission member 68*c* is set at the second position, cancels the rotation prevention of the punch unit 56 in the direction of the arrow K.

The controller 210, when performing no punching process or when the punching process is finished, permits the punch heads 60 to stand by at the HP. Therefore, generally, when the punching process is not performed, the punch unit 56 can rotate.

On the other hand, when a jam occurs and the punch heads 60 are stopped in the moved-down state, the punch unit 56 is prevented from rotation. The bunch unit 56 has a lever 132 for moving the punch head 60 to HP position manually, when the punch head 60 does not return to HP automatically by the controller 210.

The lever 132 is structured so as to rotate manually in order to rotate the power transmission member 68*a*. Further, the punch heads 60 may be pulled out manually from sheets and the lever 132 is not limited to the power transmission member 68*a*. For example, the lever 132 may rotate in order to rotate the power transmission member 68*b* and may directly press and pull, thereby move the power transmission member 68*c*.

Further, the controller 210, when a jam occurs or when, for example, the case of the apparatus is opened in the punch portion 37, detects by the punch head HP sensor 212 whether the punch heads 60 are at the HP or not. When the punch heads 60 are not at the HP, for example, the controller 210 displays it on the display 6, thereby informs a user of the necessity of manually moving the punch heads 60. When the punch heads 60 are at the HP, the controller 210 informs the user of the effect that they can be released or cancels the information of error.

According to the third embodiment aforementioned, when the punch heads 60 are pierced in sheets, the punch unit 56 can be prevented from rotation. Therefore, when a sheet jam occurs, the jam can be released without tearing the sheet by the punch heads.

The binding member 122, when the punch heads 60 are moved down, for example, is not limited to the junction to the projecting portion 124 of the power transmission member 68*c*. For example, it may be arranged away from the projecting portion 124, make contact with the punch unit 56 when it rotates, thereby prevent rotation.

Further, the binding member 122 is not limited to the one for preventing the punch heads 60 from rotation using the projecting portion 124 of the power transmission member 68*c*. The arrangement position of the binding member 122 may be on the side where the driving portion 66 is arranged.

Although the invention is shown and described with respect to certain illustrated aspects, it will be appreciated that equivalent alterations and modifications will occur to others skilled in the art upon the reading and understanding of this specification and the annexed drawings. In particular regard to the various functions performed by the above described components, the terms used to describe such components are intended to correspond, unless otherwise indicated, to any component which performs the specified function of the described component (e.g., that is functionally equivalent), even though not structurally equivalent to the disclosed structure, which performs the function in the herein illustrated exemplary aspects of the invention.

What is claimed is:

1. A sheet processing comprising:

a first detector configured to detect a leading edge of a sheet conveyed in a conveying direction;

a second detector provided on a downstream side of the first detector in the sheet conveying direction to detect the leading edge of the sheet conveyed;

a third detector provided on an upstream side of the first detector in the sheet conveying direction to detect the leading edge of the sheet conveyed;

a punching portion, in the downstream side of the first detector in the sheet conveying direction, configured to move in a sheet width direction crossing the sheet conveying direction and perform a punching process for the sheet;

an edge detector configured to move in the width direction together with the punching portion and detect the edge of the sheet in the width direction; and a controller configured to judge, on the basis of at least one of the information of a conveying speed of the sheet and a sheet length in the conveying direction, when the edge detector starts movement in the width direction after any one of the first, second, and third detectors detects the leading edge of the sheet, that the edge detector can detect the edge of the sheet, to select, as a result of the judgment, among the first, second, and third detectors, the detector positioned on the most downstream side in the conveying direction which can be used, and to permit the edge detector to start movement to detect the edge of the sheet in the width direction when the selected detector among the first, second, and third detectors detects the leading edge of the sheet conveyed.

2. The apparatus according to claim 1, wherein the first detector is a skew sensor including a first sensor and a second sensor arranged on a line in the width direction of the sheet orthogonal to the sheet conveying direction.

3. The apparatus according to claim 2, wherein the controller judges whether the edge detector can detect the edge of the sheet before the skew sensor detects the trailing edge of the sheet conveyed.

4. The apparatus according to claim 1, wherein the second detector moves in the width direction together with the edge detector.

5. The apparatus according to claim 1, wherein the controller is further configured to determine if the second detector is selectable prior to determining if the first detector is selectable and, if the second detector is selectable, selecting the second detector prior to determining if the first detector is selectable.

6. A sheet processing apparatus comprising:

a first detector configured to detect a leading edge of a sheet conveyed in a conveying direction;

a second detector provided on a downstream side of the first detector in the sheet conveying direction to detect the leading edge of the sheet conveyed;

a punching portion, in the downstream side of the first detector in the sheet conveying direction, configured to move in a sheet width direction crossing the sheet conveying direction and perform a punching process for the sheet;

an edge detector configured to move in the width direction together with the punching portion and detect the edge of the sheet in the width direction;

a third detector provided on an upstream side of the first detector in the sheet conveying direction to detect the leading edge of the sheet conveyed; and a controller selecting the detector positioned on the most downstream side in the conveying direction among the first, second, and third detectors that meet the following formula:

$$\frac{X+L}{V} > \frac{X_1}{V_1}$$

where

V: conveying speed of the sheet [m/s],

L: sheet length in the conveying direction [m],

X: distance from a standard judgment position (the upstream side of the standard judgment position in the conveying direction is positive and the downstream side of the standard judgment position is negative)[m], X1: distance after the edge detector starts movement until the edge detector detects the sheet edge [m], and V1: moving speed of the edge detector [m], and permitting the edge detector to start movement to detect the edge of the sheet in the width direction when the selected first, second, and third detectors detects the leading edge of the sheet conveyed.

7. The apparatus according to claim 6, wherein the controller is further configured to determine if the second detector is selectable prior to determining if the first detector is selectable and, if the second detector is selectable, selecting the second detector prior to determining if the first detector is selectable.

8. A processing method of a sheet processing apparatus including a first detector configured to detect a leading edge of a sheet conveyed in a conveying direction, a second detector provided on a downstream side of the first detector in the sheet conveying direction to detect the leading edge of the sheet conveyed, a third detector provided on an upstream side of the first detector in the sheet conveying direction to detect the leading edge of the sheet conveyed, a punching portion, on the downstream side of the first detector in the sheet conveying direction, configured to move in a sheet width direction crossing the sheet conveying direction and perform a punching process for the sheet, and an edge detector configured to move in the width direction together with the punching portion and detect the edge of the sheet in the width direction, comprising:

judging that the edge detector can detect the edge of the sheet on the basis of at least one of information of a conveying speed of the sheet and a sheet length in the conveying direction, when the edge detector starts movement in the width direction after one of the first, second, and third detectors detects the leading edge of the sheet;

selecting among the first, second, and third detectors, the detector positioned on the most downstream side in the conveying direction on the basis of a result of the judging; and permitting the edge detector to start movement and to detect the edge of the sheet when the selected one of the first, second, and third detectors detects the leading edge of the sheet conveyed.

9. The method according to claim 8, wherein the first detector is a skew sensor including a first sensor and a second sensor arranged on a line in the width direction of the sheet orthogonal to the sheet conveying direction.

10. The method according to claim 9, wherein the skew sensor judges whether the edge detector can detect the edge of the sheet before the skew sensor detects the trailing edge of the sheet conveyed.

11. The method according to claim 8, wherein the second detector moves in the width direction together with the edge detector.

12. The method according to claim 8, wherein the controller is further configured to determine if the second detector is selectable prior to determining if the first detector is selectable and, if the second detector is selectable, selecting the second detector prior to determining if the first detector is selectable.

* * * * *